US007396076B1

(12) United States Patent
Hock

(10) Patent No.: US 7,396,076 B1
(45) Date of Patent: Jul. 8, 2008

(54) CHAIR WITH FIRM STRUCTURE FOR OVERLAPPING

(76) Inventor: Koh Tuang Hock, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/758,674

(22) Filed: Jun. 6, 2007

(51) Int. Cl.
*A47C 3/04* (2006.01)

(52) U.S. Cl. ..... 297/239; 297/411.26; 297/411.29

(58) Field of Classification Search ..... 297/239, 297/411.26, 411.27, 411.28, 411.29
See application file for complete search history.

(56) References Cited

U.S. PATENT DOCUMENTS 3,708,202 A * 1/1973 Barecki et al. ..... 297/239
3,982,785 A * 9/1976 Ambasz ..... 297/239
4,648,653 A * 3/1987 Rowland ..... 297/239
5,064,247 A * 11/1991 Clark et al. ..... 297/239
7,147,286 B2 * 12/2006 Cesaroni et al. ..... 297/239

* cited by examiner

*Primary Examiner*—Anthony D Barfield

(57) ABSTRACT

A chair with a firm structure for overlapping has a body which includes a chair frame and at least one supporting frame; the chair frame having a base, a seat frame and a back frame for supporting the body; the supporting frame being at an outer side of the chair frame; wherein the seat frame has a seat; and the back frame has a cushion; the supporting frame has a handle; supporting frame is combined with a combining unit. The combining unit serves for combining the supporting frame and the chair frame; the chair frame has a front casing and a rear casing; each of the front casing and the rear casing has a clamping surface; the front casing is coupled to the rear casing; each of two sides of the clamping surface has a positioning groove for limiting the chair frame and the supporting frame in the combining unit.

5 Claims, 4 Drawing Sheets

CHAIR WITH FIRM STRUCTURE FOR OVERLAPPING

FIELD OF THE INVENTION

The present invention relates to chairs, and in particular to a chair with a firm structure for overlapping, wherein the chair has a simple and special structure for overlapping and moreover, the cost is low and the operation is easy and convenient.

BACKGROUND OF THE INVENTION

In many applications, after the use of chairs, the chairs must be overlapped for storage. Thus there are some designs of chairs which are aimed at to make a compact structure of chair so that the chairs can be overlapped firmly and safely.

One prior art, Taiwan Patent No. 160984, the end of chair leg is installed with a protruded pad which is buckled with a resisting end at an upper end of a leg of another chair so as to have a firm structure in overlapping. However, the pad will wear as it contacts the ground for a long time period. Finally, the pad will lose of function for resisting with the resisting end. As a result, the overlapping of the chairs are not firmly and steadily and the chairs easily fall down. Furthermore the pads and resisting ends only serve to prevent the chairs from falling down forwards or backwards, but it can not prevent the chairs from falling down leftwards, or rightwards. Thus, when the chairs are overlapped to a predetermined height, the stacks of the chairs easily fall down leftwards or rightwards so as to hurt people asides or destroy the chairs.

Besides, one end of the seat frame of the handle is locked a back of the chair and another end thereof is a concave supporting portion. The supporting portion is buckled to an upper side of a chair leg at a rear side. Then a half combined clamping portion is combined to a lower side of the leg. Then a pair of screw units are locked to the leg at the rear side. However, many components are used and thus the structure is complicated and the more part makes more cost.

SUMMARY OF THE INVENTION

Accordingly, the primary object of the present invention is to provide a chair with a firm structure for overlapping, wherein the chair is a simple and special structure for overlapping and moreover, the cost is low and the operation is easy and convenient.

To achieve above objects, the present invention provides a chair with a firm structure for overlapping, the chair having a body which includes a chair frame and at least one supporting frame; the chair frame having a base, a seat frame and a back frame for supporting the body; the supporting frame being at an outer side of the chair frame; wherein the seat frame has a seat; and the back frame has a cushion; the supporting frame has a handle; supporting frame is combined with a combining unit; the combining unit serves for combining the supporting frame and the chair frame; the chair frame has a front casing and a rear casing; each of the front casing and the rear casing has a clamping surface; the front casing is coupled to the rear casing; each of two sides of the clamping surface has a positioning groove for limiting the chair frame and the supporting frame in the combining unit.

When a plurality of bodies are overlapped, the supporting frame at an upper side will guide from the supporting frame at a lower side so that the supporting frame at an outer side will confine the chair frame; thus, the bodies chairs are overlapped more firmly and stably.

Each of the front casing and rear casing is formed with an upper inclined surface and a lower inclined surface; each of the edges of two sides of the front casing and rear casing has an inclined bending edge; by the inclined bending edges, when the front casing and rear casing are combined, a positioning groove is formed therebetween; one side of the front casing is formed with a buckling groove between two inclined bending edges at the same side so that the seat frame can pass through the buckling groove.

A connection of the supporting frame and the chair frame has a V shape; and each of the front casing and rear casing have a V shape.

Each of another side of the front casing and one side of the rear casing is formed with a buckling recess, respectively between two inclined bending edges at the same another side for assembly the seat.

A pair of the sockets and a pair of studs are used to lock the upper inclined surfaces and lower inclined surfaces of the front casing and rear casing so as to tightly engage the front casing and rear casing.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
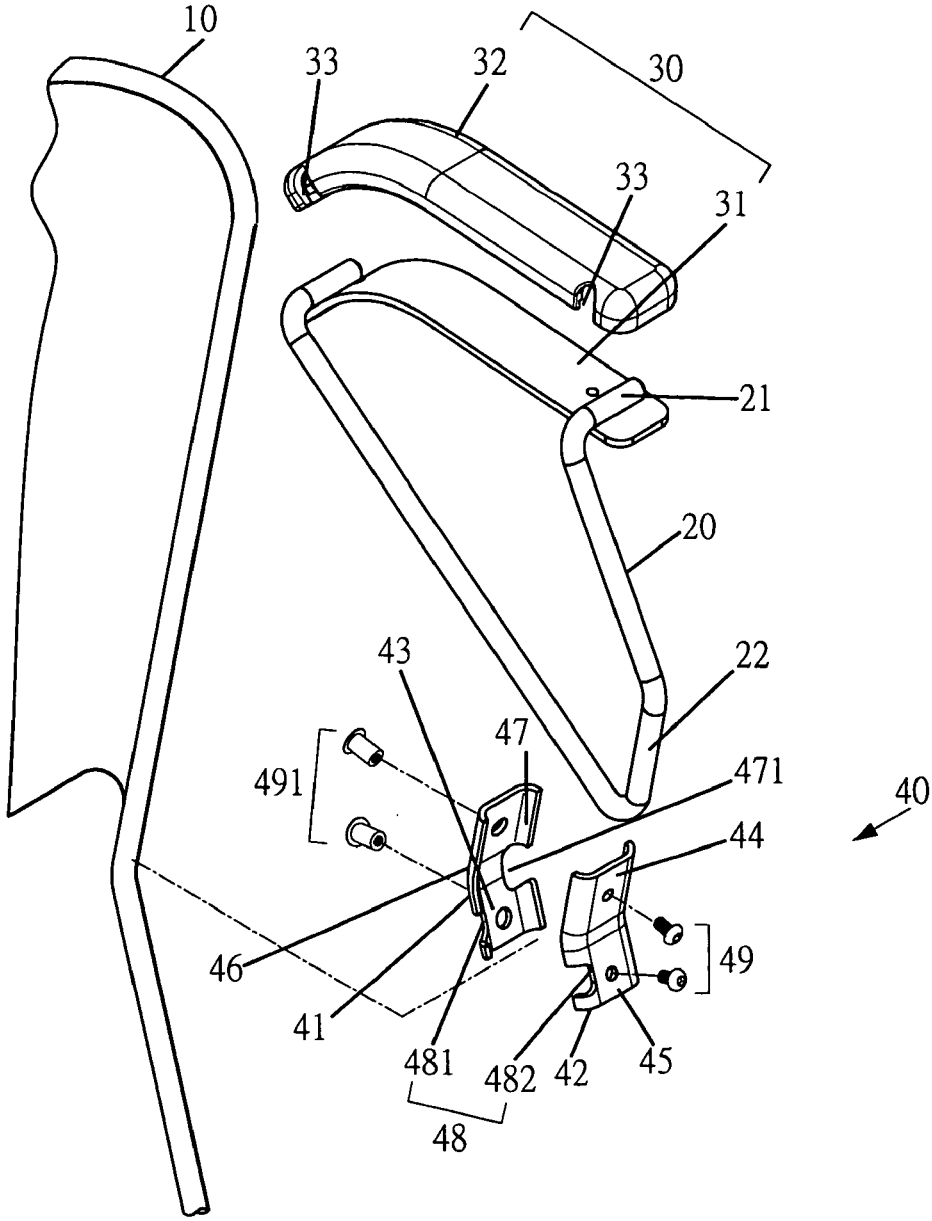
FIG. 1 is an exploded perspective view of the chair of the present invention.
Figure 2A:
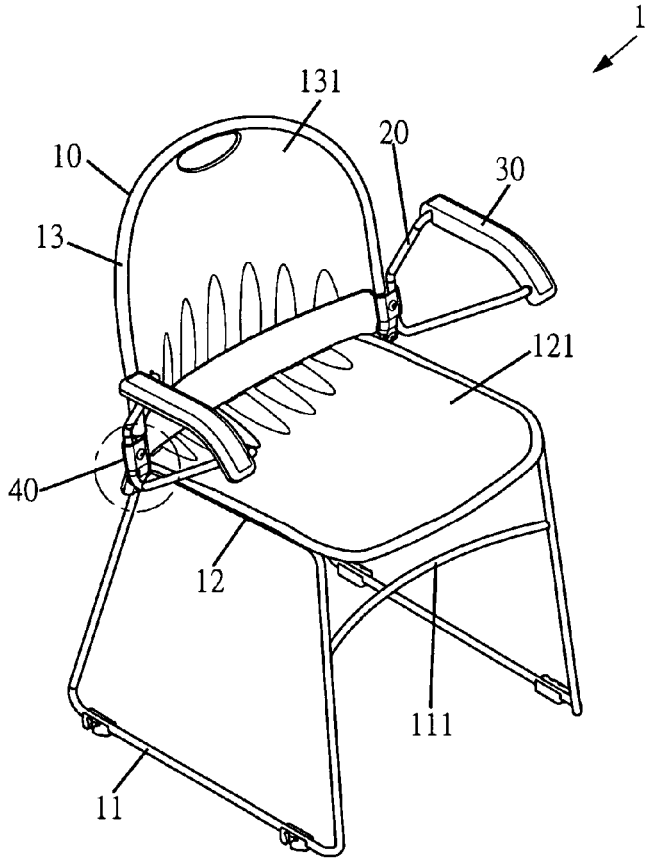
FIG. 2A is a perspective view of the present invention.
Figure 2B:
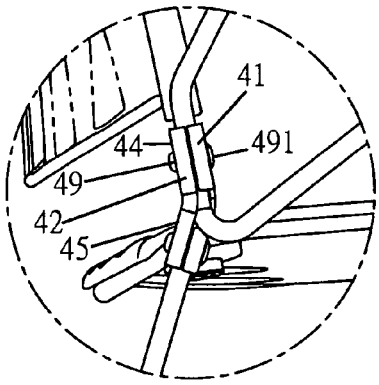
FIG. 2B is a partial enlarged view of the present invention.

Referring to FIGS. 1 to 2B, the chair structure of the present invention is illustrated. The present invention has the following elements.

A body 1 has a chair frame 10. The chair frame 10 includes a base 11, a seat frame 12, and a back frame 13. The base 11 is installed at a lower side of the chair frame 10 and has a wedge shape for supporting the body 1. A front end of the base 11 has a transversal combining rod 111 for enhancing the combining strength of the chair body. Furthermore the seat frame 12 is installed with a seat 121. The back frame 13 is formed with a cushion 131. The chair frame 10 has a V shape area near the cushion 131 and the seat 121.

The body 1 has a supporting frame 20 near a connection between the cushion 131 and the seat 121. The supporting frame 20 has a U shape and each of two ends of the supporting frame 20 has an L shape. Each L shape end is formed as an embedding portion 21. A positioning portion 22 is formed between the two L shape ends.

The supporting frame 20 is installed with a handle 30. The handle 30 has a bottom plate 31 welded upon the embedding portion 21. The bottom plate 31 is installed with a cover plate 32. The cover plate 32 is formed with two slots 33 for receiving the embedding portions 21 of the supporting frame 20 so as to increase the combining strength of the supporting frame 20 and the handle 30.

A lower side of the supporting frame 20 is installed with a combining unit 40. The combining unit 40 includes a front casing 41 and a rear casing 42. Each of the front casing 41 and rear casing 42 has a V shape. The front casing 41 is coupled to the rear casing 42. Each of the front casing 41 and rear casing 42 is formed with an upper inclined surface 44 and a lower inclined surface 45. Each of the edges of two sides of the front casing 41 and rear casing 42 has an inclined bending edge 46. By the inclined bending edges 46, when the front casing 41 and rear casing 42 are combined, a positioning groove 47 is formed therebetween. One side of the front casing 41 is formed with a buckling groove 471 between two inclined bending edges 46 at the same side, and each of another side of the front casing 41 and one side of the rear casing 42 is formed with a buckling recess 481, 482, respectively between two inclined bending edges 46 at the same another side. After combining the front casing 41 and rear casing 42, the two recesses 481, 482 are formed as a trench 48.

In assembly, the supporting frame 20 is received within the positioning groove 47 between the front casing 41 and rear casing 42 and is out of the positioning groove 47 from the buckling groove 471. The chair frame 10 passes through the positioning groove 47 and the chair frame 10 is embedded into the trench 48. A pair of the sockets 491 and a pair of studs 49 are used to lock the upper inclined surfaces 44 and lower inclined surfaces 45 of the front casing 41 and rear casing 42 so as to tightly engage the front casing 41 and rear casing 42.

Since each of the chair frame 10, front casing 41 and rear casing 42 has a V shape, when the chair frame 10 is retained in the combining unit 40, it can not slide. Furthermore the supporting frame 20 is retained by the positioning groove 47 and the buckling groove 471. Further, by using the sockets 491 and stud 49, the chair frame 10 and supporting frame 20 are combined firmly with only a few components.

Figure 3:
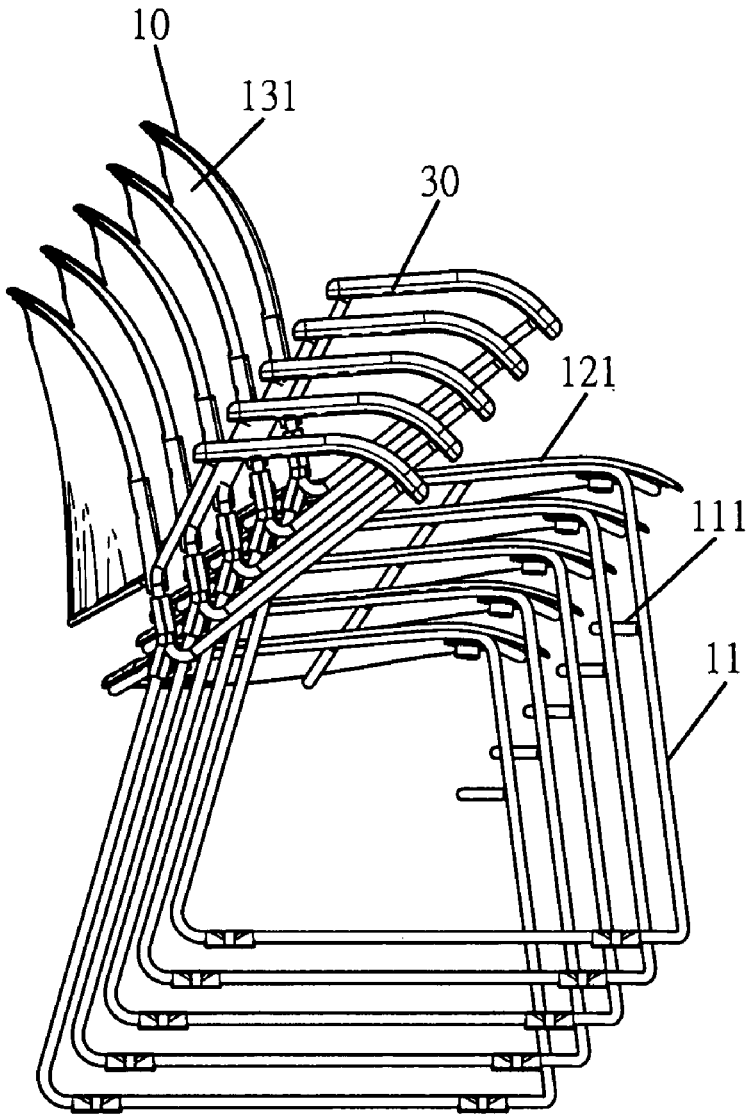
FIG. 3 is a schematic view showing the overlapping of the present invention.
Figure 4:
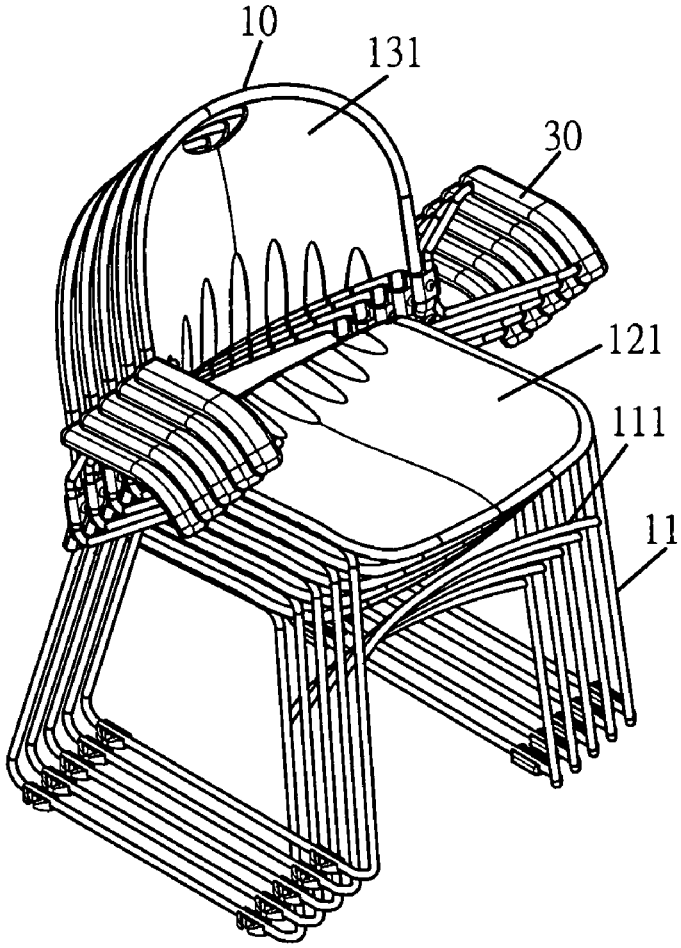
FIG. 4 is a schematic view showing the overlapping of the present invention, which is viewed from another orientation.

Referring to FIGS. 3 and 4, when a plurality of bodies 1 are overlapped, because the shape of the supporting frame 20 has a U shape, the supporting frame 20 at the upper bodies will slide along and insert into the supporting frame 20 of the lower bodies. See FIG. 3, then the supporting frame 20 at the upper side is confined by the supporting frame 20 at the lower side without shift and vibration so as to prevent the chair from falling down. Moreover, since the supporting frame 20 at the upper side slides into an inner side of the supporting frame 20 at the lower side and thus is confined therein. Moreover, the chair frame 10 resists against the supporting frame 20 at the outer side. Thus the chair frame 10 will fall down from the left or right side. When a plurality of bodies 1 are overlapped, the structure is firm and safe.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A chair with a firm structure for overlapping, the chair having a body which includes a chair frame and at least one supporting frame; the chair frame having a base, a seat frame and a back frame for supporting the body; the supporting frame being at an outer side of the chair frame; wherein the seat frame has a seat; and the back frame has a cushion;

the supporting frame has a handle; supporting frame is combined with a combining unit; the combining unit serves for combining the supporting frame and the chair frame;

the chair frame has a front casing and a rear casing; each of the front casing and the rear casing having a clamping surface; the front casing being coupled to the rear casing; each of two sides of the clamping surface has a positioning groove for limiting the chair frame and the supporting frame in the combining unit;

wherein when a plurality of bodies are overlapped, the supporting frame at an upper side will guide from the supporting frame at a lower side so that the supporting frame at an outer side will confine the chair frame; thus, the bodies chairs are overlapped more firmly and stably.

2. The chair as claimed in claim 1, wherein each of the front casing and rear casing is formed with an upper inclined surface and a lower inclined surface; each of the edges of two sides of the front casing and rear casing has an inclined bending edge; by the inclined bending edges, when the front casing and rear casing are combined, a positioning groove is formed therebetween; one side of the front casing is formed with a buckling groove between two inclined bending edges at the same side so that the seat frame can pass through the buckling groove.

3. The chair as claimed in claim 1, wherein a connection of the supporting frame and the chair frame has a V shape; and each of the front casing and rear casing have a V shape.

4. The chair as claimed in claim 2, wherein each of another side of the front casing and one side of the rear casing is formed with a buckling recess, respectively between two inclined bending edges at the same another side for assembly the seat.

5. The chair as claimed in claim 1, wherein a pair of the sockets and a pair of studs are used to lock the upper inclined surfaces and lower inclined surfaces of the front casing and rear casing so as to tightly engage the front casing and rear casing.

* * * * *